US005567477A

United States Patent [19]

Snyder, Jr.

[11] Patent Number: 5,567,477

[45] Date of Patent: Oct. 22, 1996

[54] METHOD AND APPARATUS FOR PUMPING HIGH VISCOSITY FLUIDS

[76] Inventor: Guy T. Snyder, Jr., 143 Belle Chase Dr., Lexington, S.C. 29072

[21] Appl. No.: 502,886

[22] Filed: Sep. 22, 1995

[51] Int. Cl.[6] ..... B05D 1/32; B05D 5/00

[52] U.S. Cl. ..... 427/282; 118/46; 417/326; 417/393; 427/288; 427/389.9

[58] Field of Search ..... 118/46; 417/326, 417/393; 427/256, 282, 288, 389.9

[56] References Cited

U.S. PATENT DOCUMENTS

| | | | |
|---|---|---|---|
| 3,610,782 | 10/1971 | McGuire | 417/326 |
| 3,967,009 | 6/1976 | Blake | 427/282 X |
| 4,444,103 | 4/1984 | Mitter | 68/202 X |
| 4,566,867 | 1/1986 | Bazan et al. | 417/393 |
| 4,708,601 | 11/1987 | Bazan et al. | 417/393 |
| 5,050,498 | 9/1991 | Smith | 101/127.1 |

*Primary Examiner*—Michael Lusignan
*Attorney, Agent, or Firm*—Michael A. Mann, P. A.

[57] ABSTRACT

A method and apparatus for pumping high viscosity paints. The apparatus comprises a double diaphragm pneumatic pump having means for controlling the air exhaust rate from the diaphragms to thereby reduce the diaphragm cycling rate. The decreased diaphragm cycling rate enables high viscosity paint to be drawn into the pump chambers and thereby avoids cavitation and increases the output flow rate. In a preferred embodiment, the bleed port, which vents air from the diaphragms to the atmosphere, is fitted with a needle valve, enabling the exhaust rate to be variably controlled. An alternative embodiment comprises a pump fitted with a valve received by the main exhaust of the air motor to thereby control the exhaust rate from the diaphragms.

22 Claims, 4 Drawing Sheets

METHOD AND APPARATUS FOR PUMPING HIGH VISCOSITY FLUIDS

BACKGROUND OF THE INVENTION

1. Field of the Invention

The present invention relates to a method and apparatus for pumping high viscosity fluids. More specifically, the present invention is a method and apparatus for the delivery of high viscosity paint to moving textile material.

2. Discussion of Background

In the screen printing of textiles, double diaphragm air pumps are used to pump paint through an apertured tube into the interior of a rotary screen, whereafter the paint is forced through the screen and onto a continuous moving sheet of textile material.

The double diaphragm pumps used in such applications have an inlet port into which paint is delivered and an outlet port through which paint is expressed. Two opposing chambers are both fitted with an internal diaphragm. These diaphragms are connected to one another by a reciprocating connecting rod which is actuated by a piston. When actuated, the connecting rod moves the diaphragms to alternatively create a negative and positive pressure within the interior of the chambers. A stroke of the piston results in one chamber experiencing a positive pressure, thereby forcing the paint toward the outlet port. During the same stroke, the opposing chamber experiences a negative pressure, and thereby draws paint from the inlet port. In many double diaphragm pumps, a bleed port, positioned within the housing of the pump, enables air generated by the movement of the diaphragms to be freely vented to the atmosphere. In other double diaphragm pumps, the bleed port is eliminated, and the air generated by the diaphragms is routed through the main exhaust port of the air motor and subsequently to the atmosphere.

The paint used to decorate textile materials, often referred to as "color," "dye paste," "dye stuffs," or "chemicals", is comprised of at least one pigment and a carrier. The paints that impart lighter, softer colors normally require a minimum of pigment, and consequently, the resulting paints are lighter and less viscous, i.e., less than 10,000 centipoise. Lately, shifts in tastes and fashions have prompted the textile industry to switch to the darker, deeper colors as demanded by consumers. These richer, darker colors require a greater quantity of pigment, and therefore, the viscosity of the resulting paint is greater. These darker, richer paints can have a viscosity in the range of 10,000 to 35,000 centipoise.

A major problem confronting the textile industry, as well as other industries involved in transporting high viscosity fluids, is the inability of existing double diaphragm pneumatic pumps to efficiently forward high viscosity (>10,000 centipoise) fluids to rotary screen. This inefficiency is a consequence of the speed at which the connecting rod moves back and forth. When a diaphragm "cycle", i.e., the time taken for the connecting rod to fully extend within one chamber of the pump, is too rapid, insufficient time is given to draw a sufficient amount of viscous fluid into the chamber. Thereafter, when subjected to a positive pressure, the fluid within the chamber cavitates. This cavitation prevents fluid flow toward the outlet of the pump, and reduces the amount of fluid flow through the inlet. This results in an unsatisfactory output flow rate.

The textile industry's response to the problem of efficiently pumping high viscosity paints has been to slow down the conveyor which carries the moving textile material. This solution is clearly unsatisfactory, since it increases production costs and invariably increases unit costs.

Therefore, there exists a need for a double diaphragm pump that can draw a sufficient amount of viscous fluid within the interior of the chambers and thereby efficiently pump high viscosity fluids.

SUMMARY OF THE INVENTION

According to its major aspects and briefly stated, the present invention is a method and system for delivering high viscosity fluids to a material. The present invention is also a double diaphragm pump having means for reducing the cycling speed of the diaphragms, thereby preventing cavitation within the chambers and allowing high viscosity fluids to be pumped at efficient flow rates.

In a preferred embodiment, the bleed port of the pump is equipped with a valve, enabling the restriction of the rate at which air, generated by the movement of the diaphragms, is exhausted from the interior of the chambers. This reduced exhaust rate creates a back pressure on the diaphragms, which reduces the speed at which the connecting rod cycles. As used herein, a "cycle" is achieved when the connecting rod is fully extended within one of the chambers of the pump. In turn, more time is allowed for viscous fluids to be drawn into the chambers, thereby minimizing cavitation and maximizing the output flow rate.

In an alternative preferred embodiment, the main exhaust port of the air motor is equipped with a valve which restricts the rate at which air from the diaphragms is exhausted to the atmosphere.

A very important feature of the present invention is the reduction of the diaphragm cycling rate. By reducing this cycling rate, the output flow rate of fluids with a viscosity of over 10,000 centipoise is greatly increased. One advantage gained by this increased flow rate is reduced priming time of the apertured tube. For example, in the textile industry, when a new paint is needed for the production of a certain colored textile, a certain amount of time is required for the paint to be primed the entire length of the apertured tube. By increasing the flow rate of the paint being pumped, this time is greatly reduced, thereby increasing machine production time.

Another advantage of the increased flow rate, resulting from the reduced cycling rate of the diaphragms, is an increase in production output. In the textile industry, for example, existing pump designs enabled an output of 15 yards of material per minute when pumping a 25,000 centipoise paint. The present invention enables the same viscosity paint to be pumped at a rate sufficient to achieve an output of approximately 100 yards per minute. This increase in output significantly reduces the cost of production.

Still another advantage gained by the reduced cycling of the diaphragms is a reduction in utility costs. Because the diaphragms are cycling at a lower rate, less compressed air is required to drive the air motor.

Still another advantage obtained is a reduction of maintenance costs. Since the diaphragms cycle slower, there is less fatigue imparted on the diaphragm elastomers, ball valves and air motor. Consequently, downtime is minimized while the useful life of the pump is increased.

Other features and their advantages will be apparent to those skilled in the art from a careful reading of the Detailed Description of Preferred Embodiments accompanied by the following drawings.

DETAILED DESCRIPTION OF PREFERRED EMBODIMENT

The present invention is an apparatus for pumping high viscosity fluids. The present invention is also a method and apparatus for applying high viscosity paints to a textile material. The present invention specifically addresses the problem of pumping paints with a viscosity exceeding 10,000 centipoise. Heretofore, pumping high viscosity paints has presented the textile industry with significant problems. In particular, the industry has been unable to achieve adequate output flow rates due to the rapid cycling of the diaphragms within the pump chambers. Prior to the instant invention, such pumps cycled at a rate between 200 and 240 times per minute. At such a rate, an insufficient amount of paint is drawn into the chambers. Consequently, when a positive pressure is exerted on the chamber, the pump begins to cavitate. Thus, the pump produces an unacceptable output flow rate.

It will be appreciated that although specific reference has been made to the pumping of high viscosity paints, the present invention is anticipated for use in pumping all high viscosity fluids. Such high viscosity fluids include, but are not limited to, oils, pastes, certain chemicals compounds, molten metals, sewage, and gelatinous compounds.

Figure 1:
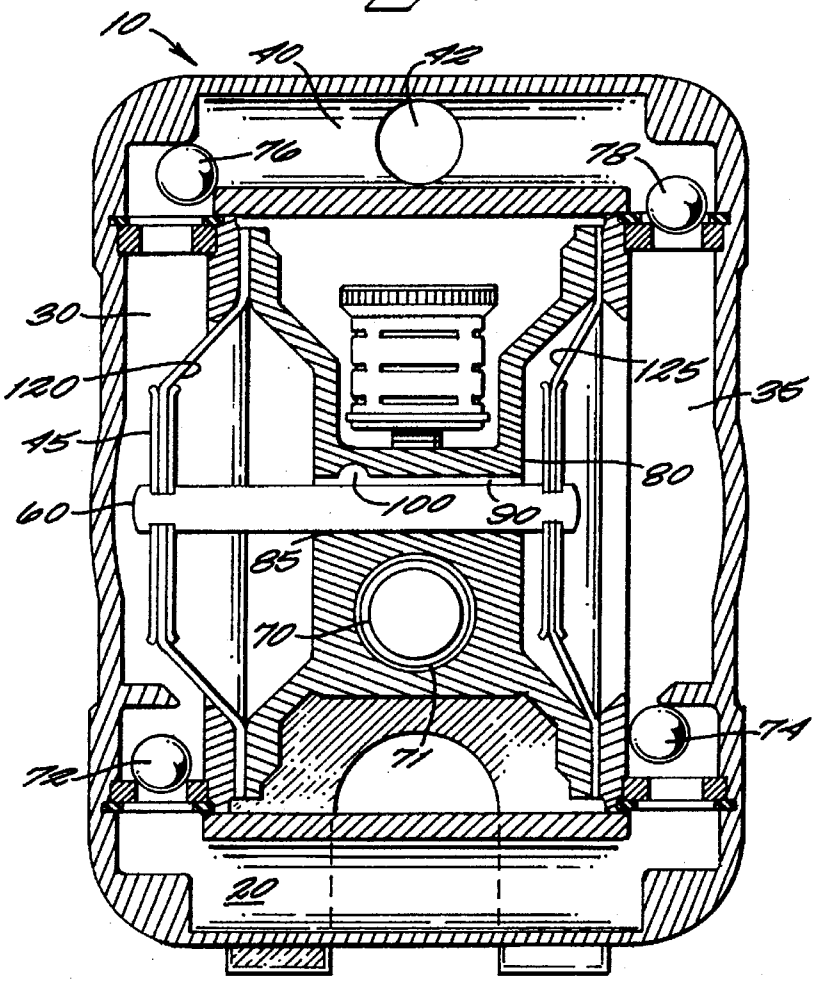
FIG. 1 is a cross sectional view of a double diaphragm air pump according to a preferred embodiment of the present invention.
Figure 2:
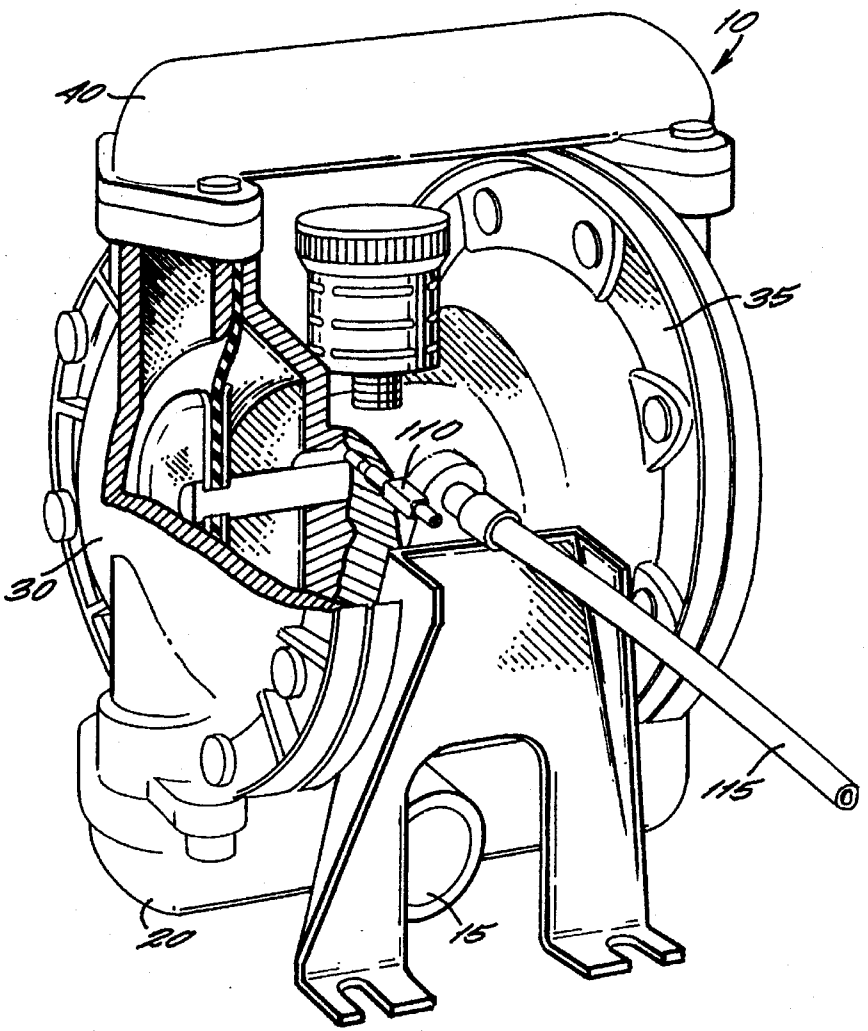
FIG. 2 is a partial cut away of a double diaphragm air pump according to a preferred embodiment of the present invention.
Figure 3:
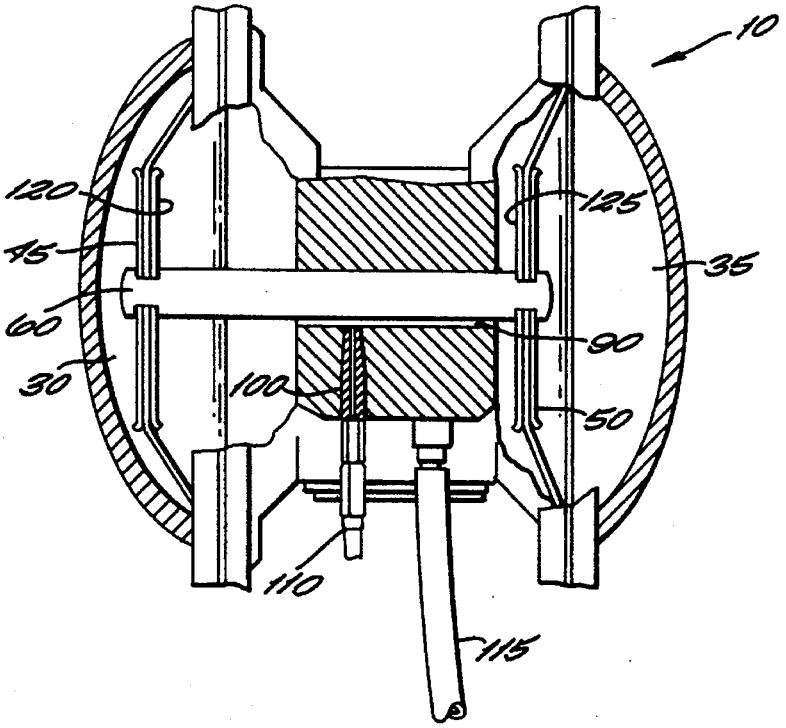
FIG. 3 is a cross sectional top view of a double diaphragm pump according to a preferred embodiment of the present invention.

Referring now to FIGS. 1 through 3, there is shown a pneumatic double diaphragm pump according to a preferred embodiment of the present invention and generally indicated by reference numeral 10. Pump 10 comprises an inlet port 15 in fluid communication with an inlet manifold 20, a pair of opposing chambers 30 and 35, and an outlet manifold 40 in fluid communication with an outlet port 42. Diaphragms 45 and 50 reside within chambers 30 and 35 respectively, and are attached to a reciprocating connecting rod 60. Connecting rod 60 is actuated by piston 70. Ball valves 72, 74, 76 and 78 are positioned at the entrances and exits of chamber 30 and 35, and are individually seated and unseated by the pressure residing within chambers 30 and 35 to thereby control the flow of paint through pump 10.

Housing 80 contains an annulus 85 through which connecting rod 60 resides. The diameter of annulus 85 is greater than the diameter of connecting rod 60 so as to define a space 90 which is in fluid communication with both chamber 30 and 35. A bleed port 100, fitted within housing 80, is in fluid communication with space 90 and the atmosphere external to pump 10. Bleed port 100 serves to exhaust air, generated by the movement of diaphragms 45 and 50, from chambers 30 and 35 to the external atmosphere.

Fitted within bleed port 100 is a valve 110 to control the rate at which air is exhausted by chambers 30 and 35. Valve 110 can be any type of valve commonly employed in the art, that is capable of restricting the air exhaust rate from chambers 30 and 35, through bleed port 100 and into the external atmosphere. Preferably, valve 110 is a needle valve received by bleed port 100. The needle valve allows one to control the air exhaust rate in accordance with the viscosity of the paint being pumped. Alternatively, valve 110 may be omitted and the air exhaust rate controlled by dimensioning the size of bleed port 100.

A needle valve is easily added to existing, high-cycle rate, dual diaphragm pumps to reduce their cycling rate. However, it will be clear that new pumps with low cycling rates, preferably less than 100 cycles per minute, and, most preferably, in the range of 60 to 80 cpm, can be made with, for example, small bleed ports or other ways known to those skilled in the art of pump design, for achieving the requisite pump speed.

In screen printing textiles, furthermore, it is not necessary to be able to adjust the speed of the diaphragm pump, only to have it controlled so that the pump cycles at the desired rate (less than 100 cpm, or preferably, between 60–80 cpm), because the paints being used in textile screen printing are all sufficiently viscous so that no higher pump cycling rates are needed.

In use, pump 10 is activated by introducing compressed air from a source (not shown) through air tube 115 into piston chamber 71. The compressed air drives piston 70 which in turn actuates connecting rod 60. As shown in FIG. 3, connecting rod 70 will move to the extreme left position. At such time when connecting rod 60 is in the extreme left position, the movement of diaphragm 45 will result in chamber 30 experiencing a positive pressure. This positive pressure will seat ball valve 72 and thereby prevent paint contained in inlet manifold 20 from entering chamber 30. Additionally, the positive pressure will unseat ball valve 76, thereby allowing any paint contained in chamber 30 to be expelled therefrom and into outlet manifold 40.

Concomitantly, chamber 35 will experience a negative pressure, thereby seating ball valve 78 and unseating ball valve 74. This enables paint from inlet manifold 20 to be drawn into chamber 35. At the completion of one stroke of the piston, connecting rod 60 will reciprocate and move toward the extreme right position, thereby evacuating chamber 35 and filling chamber 30.

As the connecting rod 60 reciprocates between the extreme right position and the extreme left position, valve 110 will restrict the air exhaust rate so that a back pressure is developed and exerted on backsides 120 and 125 of diaphragms 45 and 50, respectively. This back pressure will slow the speed at which connecting rod 60 moves between the extreme right position and the extreme left position. As a consequence, more time is allotted for high viscosity paint to be drawn into chambers 30 and 35.

Figure 4:
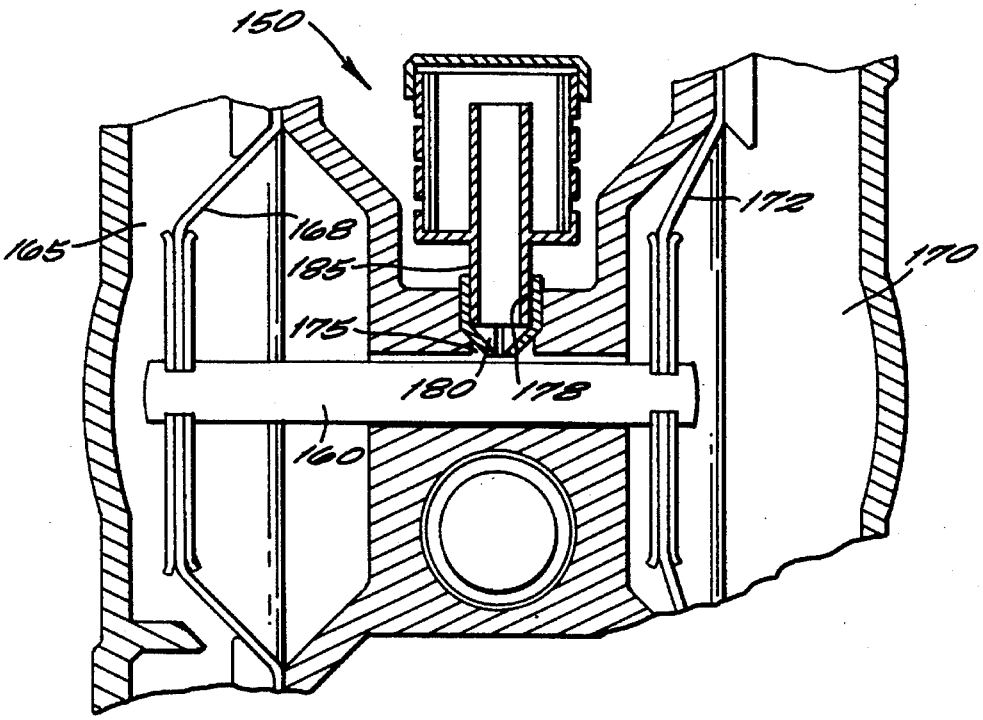
FIG. 4 is a cross section view of a double diaphragm air pump according to an alternative preferred embodiment of the present invention.

Referring to FIG. 4 there is illustrated a double diaphragm pump according to an alternative embodiment of the present invention generally indicated by reference numeral 150. Pump 150 contains an annulus 160 in fluid communication with both chambers 165 and 170. The air generated by the movement of diaphragms 168 and 172 within chambers 165 and 170, respectively, is transported through annulus 160 to the air motor's main exhaust 175 where it is expressed to the external atmosphere. Main exhaust 175 is fitted with a valve 180 which regulates the air flow rate from chambers 165 and 170. Valve 180 can be any type of valve commonly employed in the art, that is capable of restricting the air exhaust rate from chambers 165 and 170, through main exhaust 175 and into the external atmosphere. Preferably, valve 180 is a needle valve received by main exhaust 175 and contains a female thread 178 into which a main exhaust muffler 185 may be received. The needle valve allows one to control the air exhaust rate in accordance with the viscosity of the fluid being pumped.

Figure 5:
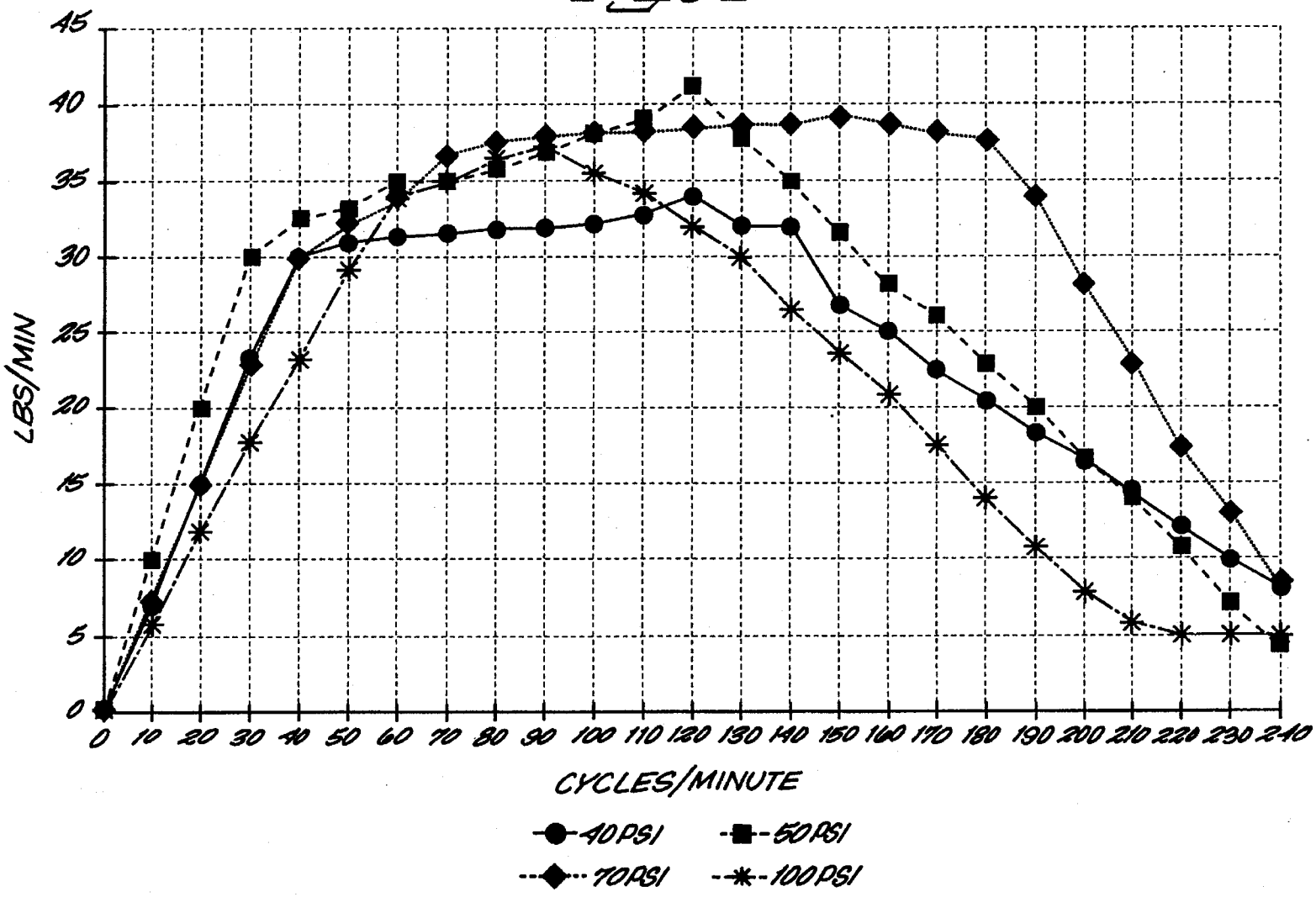
FIG. 5 is a graph depicting output flow rate as a function of the cycling rate for a 25,000 centipoise paint at various air input pressures, according to a preferred embodiment of the present invention.

Turning now to FIG. 5, there is shown a graph depicting the output flow rate (lbs/min.) of a 25,000 centipoise paint as a function of cycles per minute, given a constant air input pressure. As can be seen, maximum flow rates are achieved in the range of approximately 60 to 140 cycles. Thus, it is preferred that valve 110 be set to restrict the air exhaust rate so that a cycling rate within the range of 60 to 140 cycles may be obtained. Most preferably, valve 110 is set to achieve a cycling range of between 60 and 80 cycles. In this range, utility and maintenance costs are minimized, while the output flow rate is close to maximization.

Figure 6:
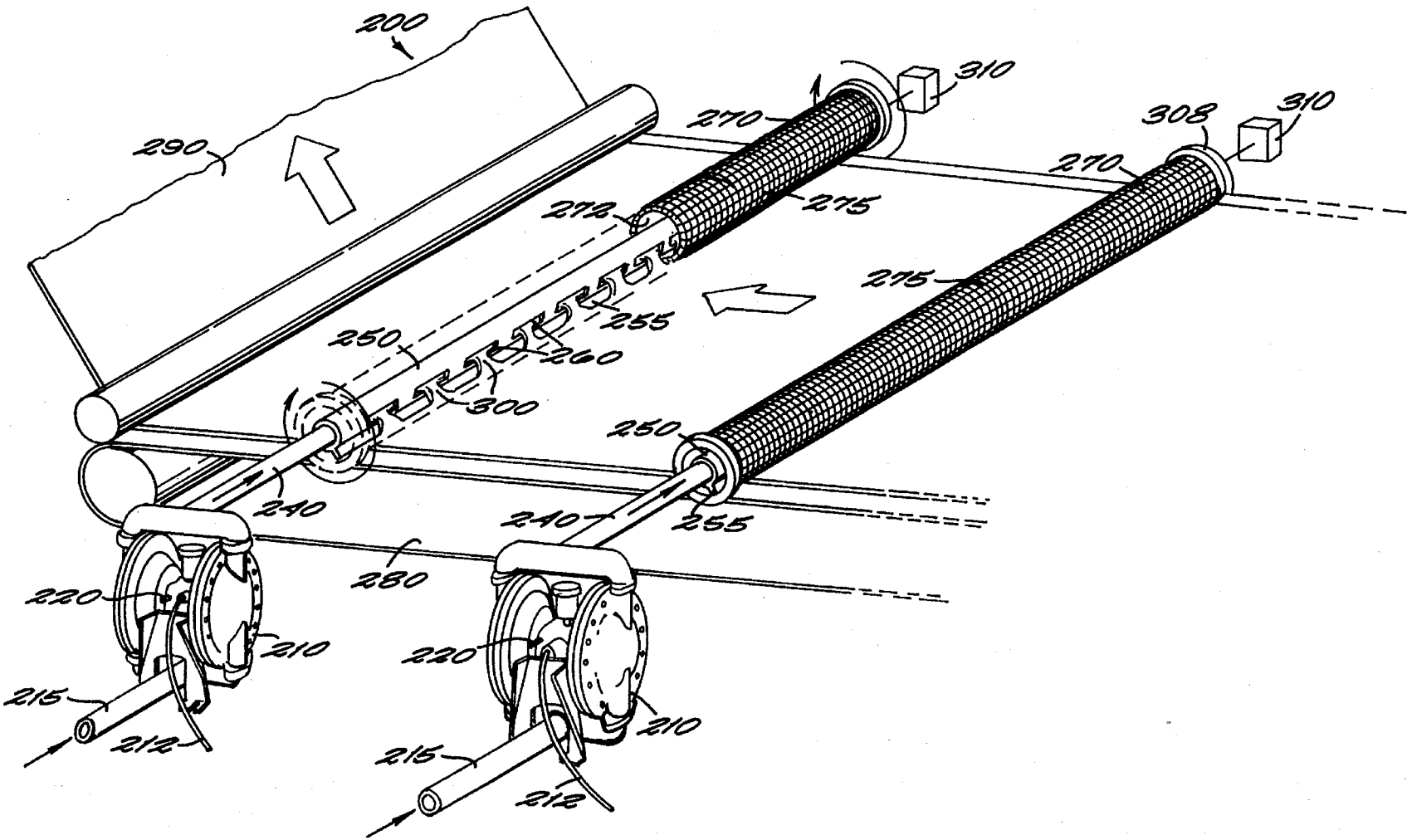
FIG. 6 is a partial cross sectional perspective view of a system for screen printing textiles according to a preferred embodiment of the present invention.

Referring now to FIG. 6, there is shown a perspective view of a textile screen printing system according to a preferred embodiment of the present invention and generally designated by reference numeral 200. Apparatus 200 comprises a double diaphragm pump 210, a tube 250 with a flange 255 extending therefrom, and a plurality of apertures 260 formed therein. Tube 250 has a closed end 308 A screen 270 surrounds tube 250 and contains a series of holes 275 which correspond to a particular decorative pattern. A conveyor belt 280 is located below screen 270 and continuously transports textile material 290 in the direction indicated.

In operation, pump 210 is activated using a source of compressed air (not shown) through air inlet tube 212. High viscosity paint 300 is then fed into pump 210 via inlet manifold. 215. Pump 210 contains a bleed port 215 fitted with a valve 220 which controls the air exhaust rate, thereby ensuring that the speed of pump 210 does not exceed 140 cycles per minute. Paint 300 is forwarded from pump 210 through outlet manifold 240 and subsequently into tube 250. Paint 300 issues from tube 250 through apertures 260 onto the interior 272 of screen 270. Screen 270 is rotated at the same speed as textile material 290 while flange 255 forces paint 300 through holes 275 and onto moving textile material 290. In operational connection with pump 210 is a detecting means 310, preferably a sensor connected to a solenoid valve, located at end 308 of tube 250. Detecting means 310 detects the presence of paint 300 at the aperture 260 most proximate to end 308. When detecting means 310 detects a high level of paint 300, a signal will be sent to turn off pump 210. When paint 300 is below a preselected level, a signal will be sent to start pump 210.

It is to be appreciated that system 200 may contain as many pump, screen and tube configurations as there are colors in a particular color pattern to be printed on a piece of textile material.

It is acknowledged that although FIG. 6 depicts a textile screen printing system that utilizes a pump having a bleed port fitted with a valve, it is within the spirit and scope of the present invention for the textile screen printing system to be used with a pump which exhausts the air generated by the diaphragms through the main exhaust port. In such a configuration, the main exhaust port of the pump would be fitted with a valve as illustrated in FIG. 4.

It will be apparent to those skilled in the art that many modifications and substitutions can be made to the preferred embodiment just described without departing from the spirit and scope of the invention as defined in the appended claims.

What is claimed is:

1. A textile screen printing system for applying paint to a moving textile material, said system comprising:

a double diaphragm pump for pumping said paint, said pump having an inlet port, an outlet port, a housing, and a pair of diaphragms, said housing having a bleed port formed therein, said diaphragms being located within said housing, and wherein movement of said diaphragms exhausts air through said bleed port into the atmosphere exterior to said housing at an exhaust rate;

means for controlling said exhaust rate so that said pump operates at a speed of less than 140 cycles per minute;

a tube having a first and an opposing second end, said first end of said tube connected to said outlet port of said pump so that said pump and said tube are in fluid communication, said second end of said tube being closed, said tube having a plurality of apertures formed therein, said tube receiving said paint from said pump and issuing said paint from said tube through said apertures;

a screen surrounding said tube, said screen having a series of holes; and means for forcing said paint through said series of holes of said screen onto said moving textile material.

2. The system as recited in claim 1, further comprising detecting means for detecting the presence of said paint proximate to said screen, said detecting means carried by said tube, said controlling means responsive to said sensor means so that said controlling means stops said pump when said paint is detected and starts said pump when said paint is not detected.

3. The system as recited in claim 1, wherein said controlling means comprises a valve received by said bleed port.

4. The system as recited in claim 1, wherein said pump further comprises an air motor main exhaust port formed within said hem housing, and wherein movement of said diaphragms exhausts air through said main exhaust port; and wherein said controlling means comprises a valve received by said main exhaust, said valve fitted with a female thread.

5. The system as recited in claim 1, wherein said controlling means comprises a needle valve received by said bleed port.

6. The system as recited in claim 1, wherein said pump operates at a speed of less than 100 cycles per minute.

7. The system as recited in claim 1, wherein said pump operates at a speed of less than 80 cycles per minute.

8. The system as recited in claim 1, wherein said pump operates at a speed in the range between approximately 60 and 80 cycles per minute.

9. The system as recited in claim 1, wherein said controlling means comprises dimensioning said bleed port so that said pump operates at a speed of less than 140 cycles per minute.

10. The system as recited in claim 1, further comprising a conveyor belt, said conveyor belt positioned below said screen, said conveyor belt carrying said textile material thereon.

11. A pump for pumping high viscosity fluids, said pump comprising:

a housing having an inlet port and an outlet port;

a pair of opposing chambers in said housing, said pair of opposing chambers in fluid communication with said inlet port and said outlet port;

a pair of diaphragms in said housing, each diaphragm of said pair of diaphragms positioned in a chamber of said pair of opposing chambers;

a rod connecting said pair of diaphragms, said rod moving said diaphragms when said rod reciprocates; and means for controlling said reciprocation of said rod so that said rod reciprocates less than 140 times per minute.

12. The pump as recited in claim 11, wherein said housing has an bleed port formed therein, wherein movement of said diaphragms exhausts air through said bleed port into the atmosphere exterior to said housing at an exhaust rate, wherein said controlling means comprises a valve received by said bleed port, said valve limiting said exhaust rate of said air.

13. The pump as recited in claim 11, wherein said housing has a bleed port formed therein, wherein movement of said diaphragms exhausts air through said bleed port into the atmosphere exterior to said housing at an exhaust rate, wherein said controlling means comprises a needle valve received by said bleed port, said needle valve limiting said exhaust rate of said air.

14. The pump as recited in claim 11, wherein said rod reciprocates less than 100 times per minute.

15. The pump as recited in claim 11, wherein said rod reciprocates in the range of between approximately 60 and 80 times per minute.

16. A method for applying paint to a textile material comprising the steps of:

pumping said paint using a double diaphragm pump into an apertured tube surrounded by a screen that engages said material, wherein said pumping takes place at a rate of less than 140 cycles per minute, said rate being controlled by limiting the flow of air from the housing of said pump;

issuing said paint from said apertured tube onto said screen; and forcing said paint through said screen onto said material.

17. The method as recited in claim 16, wherein said rate is less than cycles per minute.

18. The method as recited in claim 16, wherein said rate is in the range of between approximately 60 and 80 cycles per minute.

19. A pump for pumping high viscosity fluids, said pump comprising:

a housing having an inlet port, an outlet port, and an air motor exhaust port formed therein;

a pair of opposing chambers in said housing, said pair of opposing chambers in fluid communication with said inlet port and said outlet port;

a pair of diaphragms in said housing, each diaphragm of said pair of diaphragms positioned in a chamber of said pair of opposing chambers;

a rod connecting said pair of diaphragms, said rod moving said diaphragms when said rod reciprocates, and wherein movement of said diaphragms exhausts air through said main exhaust port into the atmosphere exterior to said housing at an exhaust ram; and means for controlling said exhaust rate so that said rod reciprocates less than 140 times per minute.

20. The pump as recited in claim 21, wherein said controlling means comprises a valve received by said main exhaust port, said valve limiting said exhaust rate of said air, said valve having a female thread formed therein.

21. The pump as recited in claim 20, wherein said rod reciprocates less than 100 times per minute.

22. The pump as recited in claim 20, wherein said rod reciprocates in the range of between approximately 60 and 80 times per minute.

* * * * *